US006859179B2

(12) United States Patent
Chang

(10) Patent No.: US 6,859,179 B2
(45) Date of Patent: Feb. 22, 2005

(54) RETRACTABLE ANTENNA MODULE

(75) Inventor: Suli Chang, Tu-Chen (TW)

(73) Assignee: Fih Co., Ltd., Taipei Hsien ( * ) Notice: Subject to any disclaimer, the term of this patent is extended or adjusted under 35 U.S.C. 154(b) by 0 days.

(21) Appl. No.: 10/330,958

(22) Filed: Dec. 26, 2002

(65) Prior Publication Data

US 2004/0027297 A1 Feb. 12, 2004

(30) Foreign Application Priority Data

Aug. 8, 2002 (TW) ..... 91212239 U

(51) Int. Cl.[7] ..... H01Q 1/24
(52) U.S. Cl. ..... 343/702; 343/901
(58) Field of Search ..... 343/702, 895, 343/901, 715, 900

(56) References Cited

U.S. PATENT DOCUMENTS 4,725,845 A * 2/1988 Phillips ..... 343/702
5,168,278 A * 12/1992 Morita ..... 343/702
5,748,150 A * 5/1998 Rudisill ..... 343/702
5,859,622 A * 1/1999 Phillips ..... 343/903
6,337,671 B1 * 1/2002 Lee ..... 343/901
6,339,401 B2 * 1/2002 Oshiyama ..... 343/702
6,380,900 B1 * 4/2002 Kanayama ..... 343/702
6,573,868 B2 * 6/2003 Johnson et al. ..... 343/702

* cited by examiner

*Primary Examiner*—Tho Phan
(74) *Attorney, Agent, or Firm*—Wei Te Chung

(57) ABSTRACT

An antenna module (1) for a mobile phone in accordance with the present invention includes an antenna (2), an elastic element (3) and a feed mechanism (5). The elastic element surrounds a lower part (21) of the antenna and pushes the antenna outwardly. The feed mechanism has a connecting means (50) and a guiding groove (52). The connecting means movably engages with the antenna and slidably engages with the groove. The movement of the antenna between an extended position and a retracted position is regulated by engagement between the connecting means and the groove, and is aided by the resilience of the elastic element. A user can move the antenna between a retracted position and an extended position using one hand.

20 Claims, 6 Drawing Sheets

RETRACTABLE ANTENNA MODULE

FIELD OF THE INVENTION

The present invention relates to an antenna module, and particularly to a retractable antenna module for an electronic device.

BACKGROUND OF THE INVENTION

In recent years, particularly given the trend toward miniaturization in mobile phones, antennas of mobile phones are being designed to be retractable. One such antenna is disclosed in U.S. Pat. No. 5,710,567. Referring to this patent, the antenna device comprises a first extendable antenna and a second antenna. The first extendable antenna is movable between an extended position, where it switches on, and a retracted position, where it switches off. The first extendable antenna has a first holding device on its lower portion which cooperates with a second holding device arranged on a guide for the first extendable antenna. The holding devices cooperate to releasably lock the first extendable antenna in the extended position. The first and second holding devices comprise mutually and magnetically attractive elements. This locking means, however, requires use of magnetic elements, and thus the antenna assembly is complex, the production costs are relatively high, and the magnetic elements influence the received signals. Moreover, the first extendable antenna also requires another locking device for its retracted position. Furthermore, pulling out the first extendable antenna from the retracted position to the extended position requires two hands operating together, which is not convenient.

Therefore, an improved antenna structure for a mobile phone is desired which overcomes the disadvantages of the prior art.

SUMMARY OF THE INVENTION

A main object of the present invention is to provide a reliable antenna module for a mobile phone which can be retracted or extended with one hand.

Another object of the present invention is to provide a retractable antenna module for a mobile phone which has a simple structure.

An antenna module for a mobile phone in accordance with the present invention comprises an antenna, an elastic element and a feed mechanism. The elastic element surrounds a lower part of the antenna and exerts an outward force against the antenna. The feed mechanism has a connecting means and a groove. The connecting means is movably engagable with and connects the antenna to the groove. The antenna can move between an extended position and a retracted position as regulated by an engagement between the connecting means and the groove and as aided by the resilience of the elastic element.

Other objects, advantages and novel features of the invention will become more apparent from the following detailed description of a preferred embodiment thereof when taken in conjunction with the accompanying drawings, wherein:

DETAILED DESCRIPTION OF THE INVENTION

Figure 1:
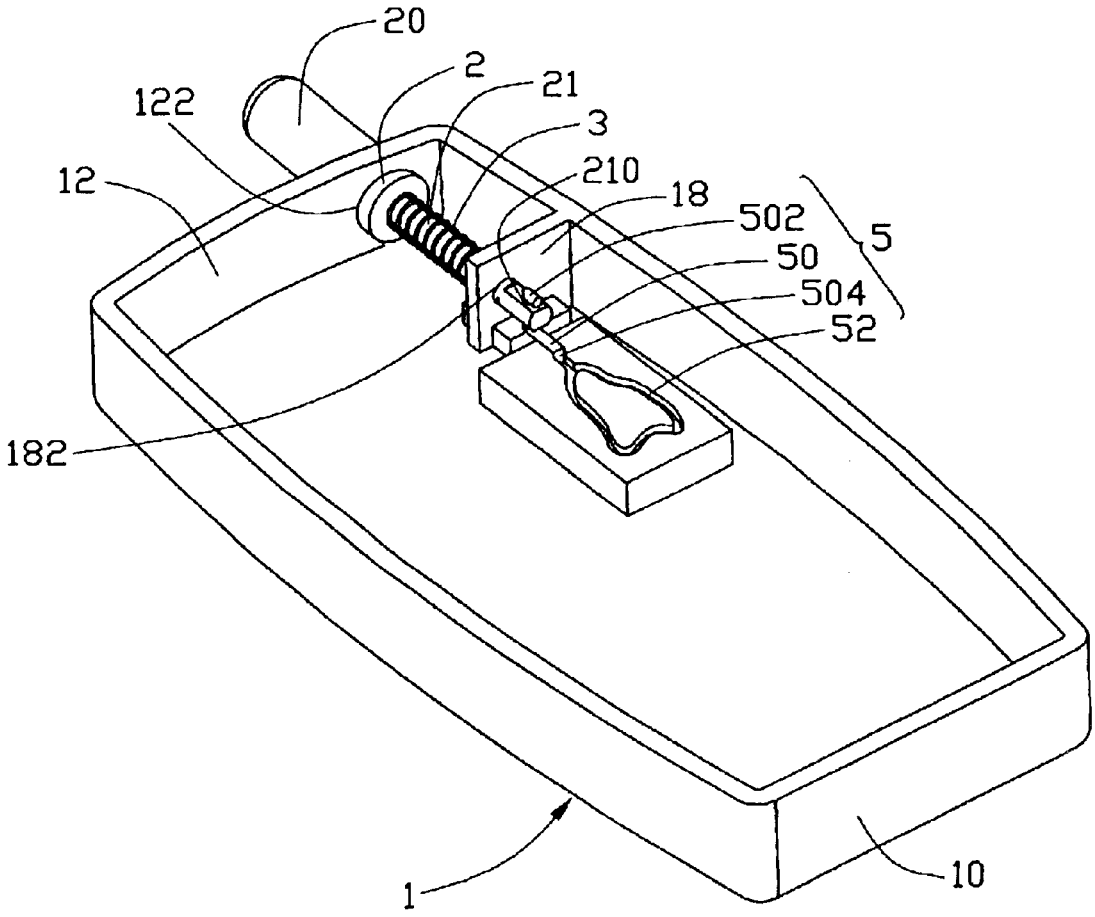
FIG. 1 is a perspective view of an antenna module in accordance with a first preferred embodiment of the present invention.

Referring now to the drawings in detail, FIGS. 1 to 5 show an antenna module 1 for a mobile phone in accordance with the first preferred embodiment of the present invention. The antenna module 1 (see FIG. 1) includes a housing 10, an antenna 2, an elastic element 3 and a feed mechanism 5. The housing 10 has a top surface 12, in which a first support opening 122 is defined. A first support plate 18 extends from a sidewall of the housing 10 and defines a second support opening 182 aligned with the first support opening 122. The antenna 2, which can move between an extended position and a retracted position, comprises an upper part 20 and a lower part 21. The upper part 20 and the lower part 21 are both circular, and are covered with plastic for insulating and protecting the antenna 2 from damage. The diameter of the upper part 20 is larger than that of the lower part 21. A hole 210 is defined through the lower part 21 of the antenna 2. The feed mechanism 5 includes a connecting means 50 and a guiding groove 52 which is defined in a second support plate (not labeled) in the housing 10. The guiding groove 52 has a heart-like contour. The connecting means 50 includes two hooks, which are a first hook 502 and a second hook 504. The feed mechanism 5 regulates the position of the antenna 2 between the extended position and the retracted position.

When assembling the antenna module 1, the antenna 2 passes through the two support openings 122 and 182 and the elastic element 3, thus the upper part 20 is supported in the first support opening 122 by the top surface 12, the lower part 21 is supported in the second support opening 182 by the support plate 18, and the elastic element 3 surrounds the lower part 21 of the antenna 2 and pushes against both the first support plate 18 and the upper part 20 of the antenna 2. The connecting means 50 connects the antenna 2 and the guiding groove 52 by means of the first hook 502 rotatably engaging with the hole 210 and the second hook 504 slidably engaging with the guiding groove 52. The second hook 504 slides in the guiding groove 52 and regulates the movement of the antenna 2 between the extended position and the retracted position.

Figure 2:
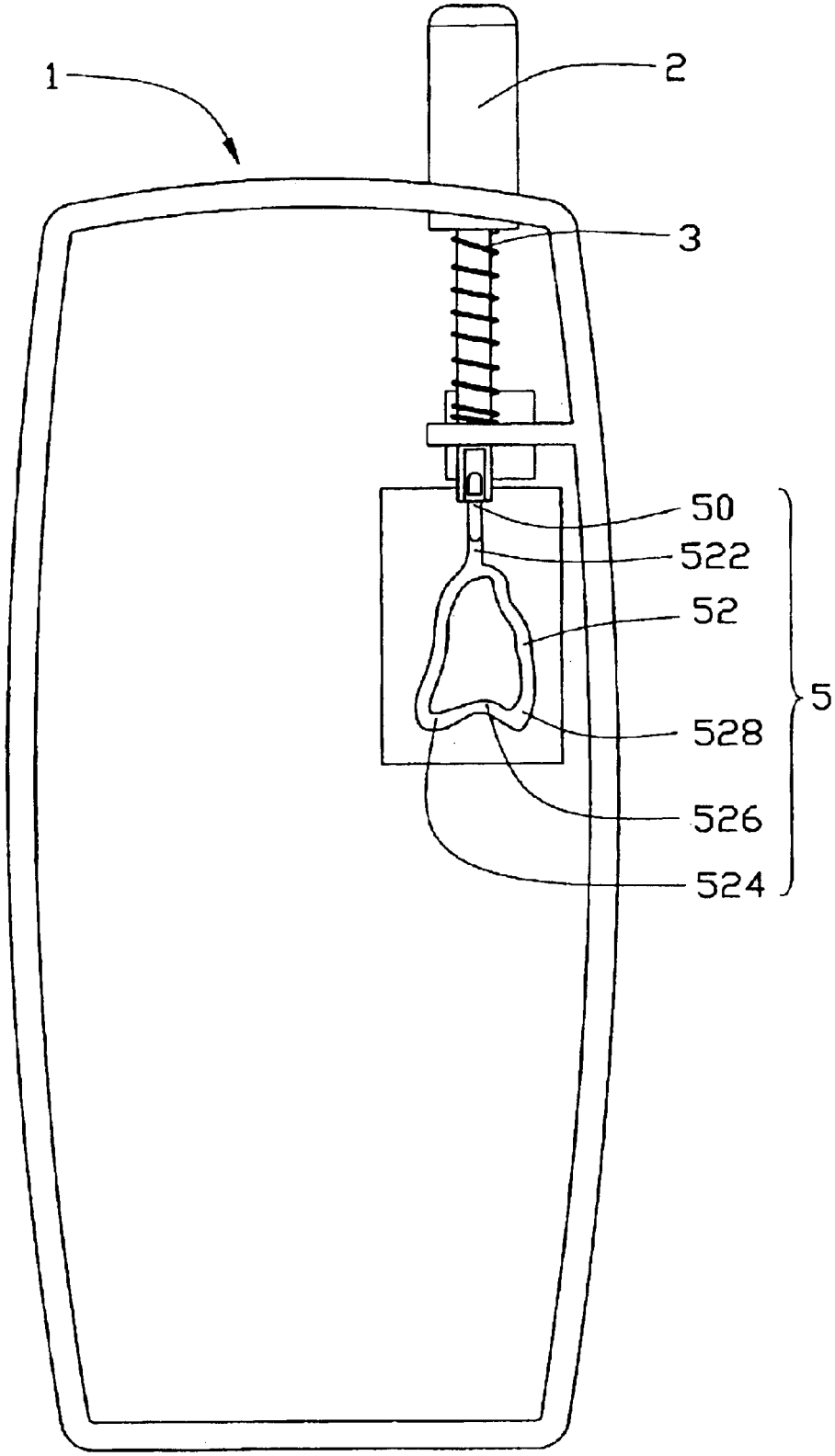
FIG. 2 is a plan view of the antenna module of FIG. 1 with an antenna in an extended position.
Figure 3:
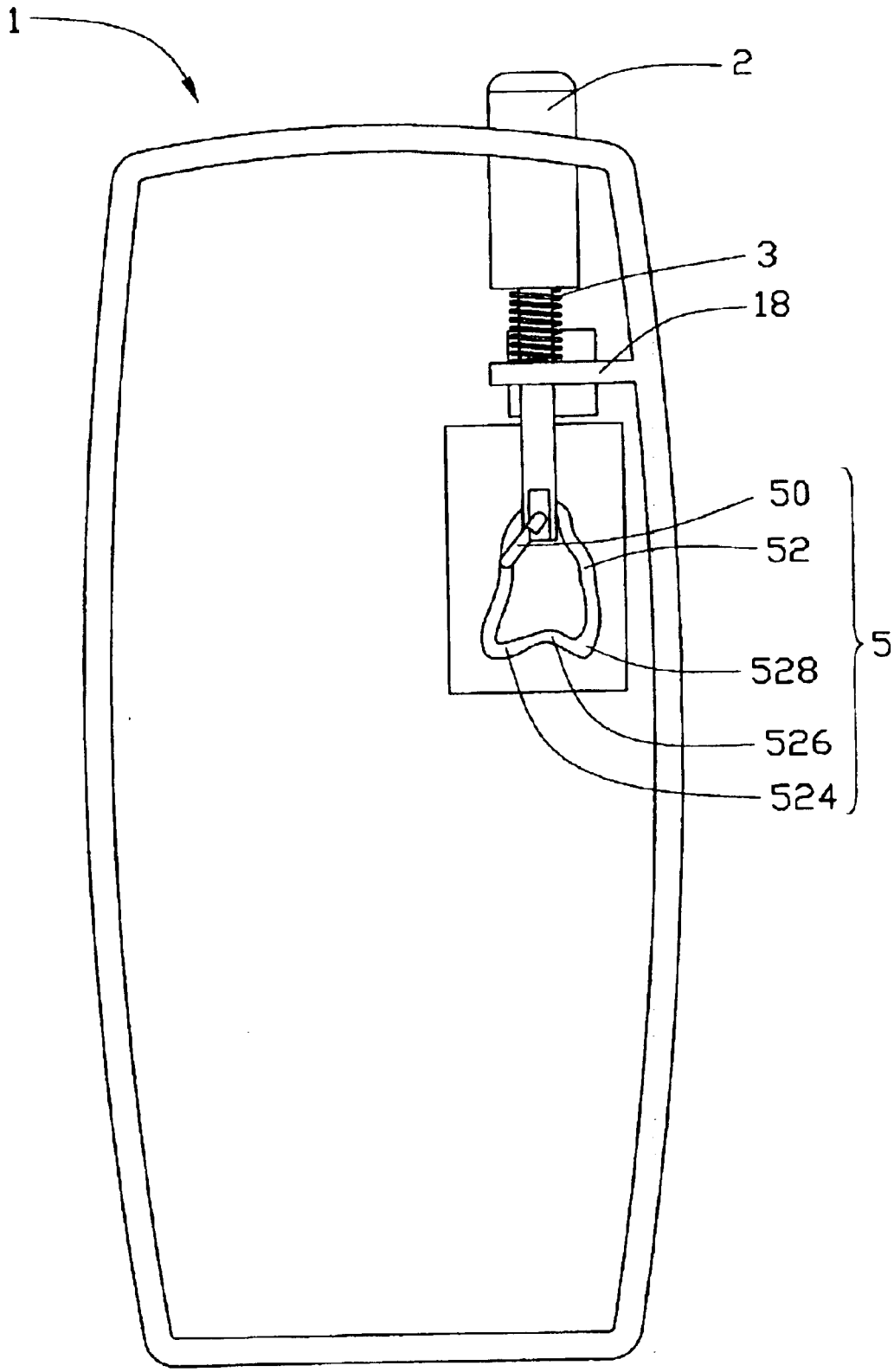
FIG. 3 is a plan view of the antenna module of FIG. 1 during a process of retracting the antenna.

FIG. 2 shows the antenna 2 in the extended position. The guiding groove 52 has two blocking portions and two lower portions, which are, a first blocking portion 522, a first lower portion 524, a second blocking portion 526 and a second lower portion 528. In the extended position, the upper part 20 of the antenna 2 extends farthest upward through the first support opening 122 and the second hook 504 is blocked at the first blocking portion 522 from allowing further upward movement of the antenna 2.

When the antenna 2 is pushed down by a force against its top surface (not labeled), the antenna 2 transfers the force to the connecting means 50 of the feed mechanism 5, thus the second hook 504 of the connecting means 50 moves downward along the guiding groove 52 from the first blocking portion 522 to the first lower portion 524, as shown in FIG.

Figure 4:
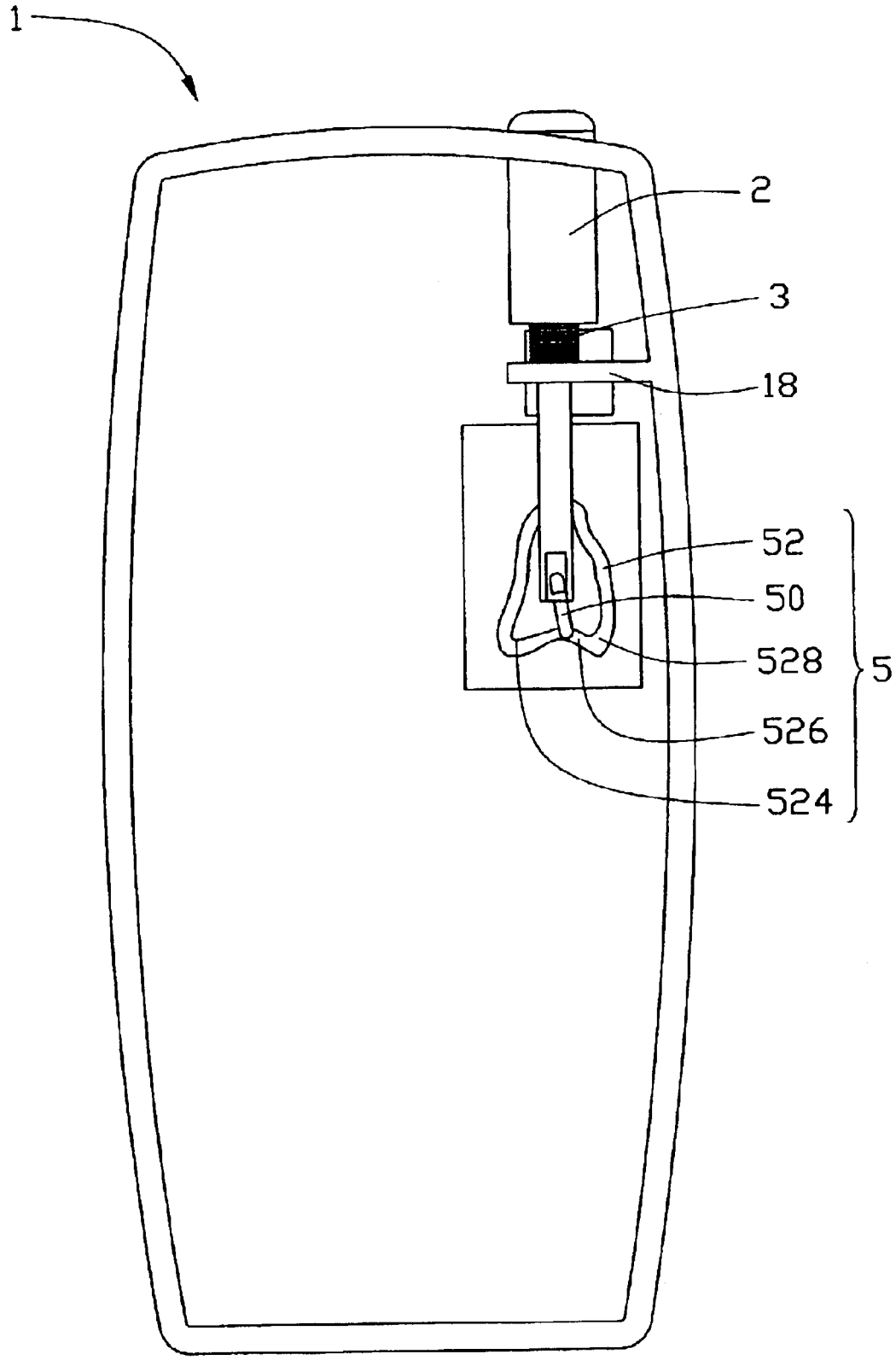
FIG. 4 is a plan view of the antenna module of FIG. 1 with the antenna in a retracted position.
Figure 5:
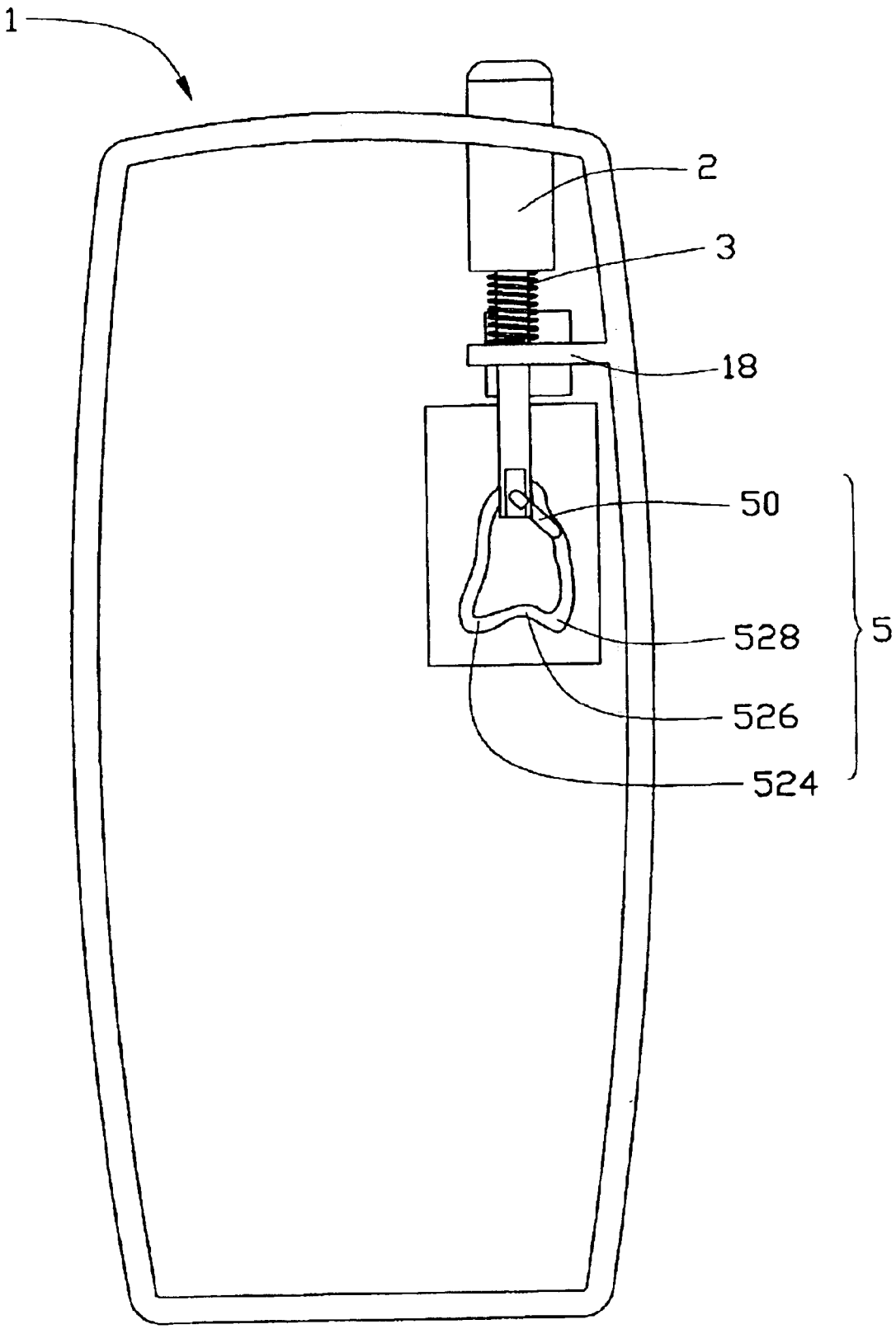
FIG. 5 is a plan view of the antenna module of FIG. 1 during a process of extension.

3, and there is blocked by the first lower portion 524, arresting further downward movement of the antenna 2. The elastic element 3 is compressed, and the antenna 2 is stopped in its lowermost position when the second hook 504 arrives at the first lower portion 524. When the downwardly pushing force is removed, the elastic element 3 drives the antenna 2 to move upwardly, therefore, and the second hook 504 moves from the first lower portion 524 to the second blocking portion 526, where further upward movement of the antenna 2 is arrested, and the antenna 2 is thereby locked in its retracted position, as shown in FIG. 4. When another downwardly pushing force acts against the top of the antenna 2, the second hook 504 moves from the second blocking portion 526 to the second lower portion 528 along the guiding groove 52, and the elastic element 3 is further compressed. When the downward pushing force is removed, the elastic element 3 drives the antenna 2 to move upwardly, so the second hook 504 moves from the second lower portion 528 upwardly to the first blocking portion 522 along the guiding groove 52, as shown in FIG. 5. When the second hook 504 arrives at and is blocked by the first blocking portion 522, as shown in FIG. 1, the antenna 2 is fully extended.

FIGS. 1 to 5 depict the motion of the antenna 2 between the extended position and the retracted position as regulated by the feed mechanism 5 and the elastic element 3. Repeating the operation described above, the antenna 2 repeats the downward and upward motions. When the second hook 504 moves along the guiding groove 52 from the first blocking portion 522 to the first lower portion 524, then to the second blocking portion 526, the antenna 2 moves from the extended position to the retracted position. When the second hook 504 moves along the groove 52 from the second blocking portion 526 to the second lower portion 528, then to the first blocking portion 522, the antenna 2 moves from the retracted position to the extended position.

A connector wire (not shown) is provided for electrically connecting the antenna 2 to a transceiver (not shown) of the mobile phone (not shown). One end of the wire is placed at and electrically connects with an end (not labeled) of the lower part 21 of the antenna 2. The other end of the wire electrically connects with the transceiver of the mobile phone.

Another means of making the electrical connection between the antenna 2 and the transceiver (not shown) of the mobile phone involves designing the connecting means 50 and the guiding groove 52 to function as electrical connectors, with the guiding groove 52 being electrically connected with the transceiver of the mobile phone.

Figure 6:
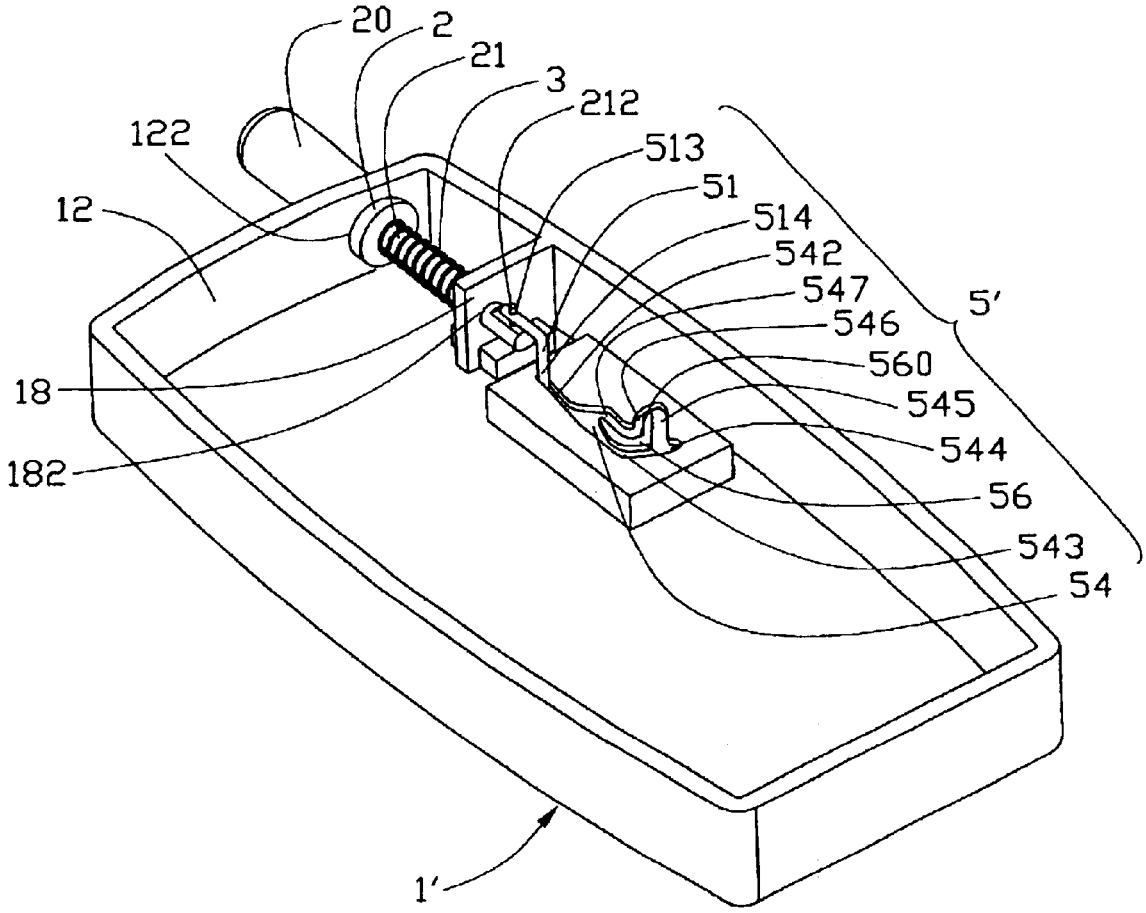
FIG. 6 is a perspective view of an antenna module in accordance with a second preferred embodiment of the present invention.

FIG. 6 shows another embodiment of the present invention. The structure of the antenna 2 is identical to that of the first embodiment. A feed mechanism 5' comprises a connecting means 51, a sea-horse shaped groove 54 and an arcuate island 56 formed in a middle of the sea-horse shaped groove 54. The island 56 defines a recess 560. In cooperation with the island 56, the sea-horse shaped groove 54 comprises the following portions: a tail portion 542, a back portion 543, a top portion 544, a face portion 545, a jaw portion 546, and an abdomen portion 547. The top portion 544 is disposed between and communicates with the back portion 543 and the face portion 545. In this embodiment according to the present invention, a pivot 212 is perpendicularly formed on an end of the lower part 21 of the antenna 2. The connecting means 51 defines a pivot opening 513 at one end and has a hook 514 at the other end. The pivot 212 is rotatably engaged with the pivot opening 513. The hook 514 is slidably received in the sea-horse shaped groove 54. When the antenna 2 is in the extended position, the elastic element 3 is under the least compression, and the hook 514 is blocked by an end of the tail portion 542 of the groove 54 from further upward movement. When an outside force pushes down on the antenna 2, the antenna 2 moves downwardly and the hook 514 moves along the back portion 543 to the top portion 544 of the groove 54. The elastic element 3 is compressed, and the antenna 2 reaches its lowermost position. When the pushing force is removed, the antenna 2 moves upwardly because of the resilience of the elastic element 3, and as a result, the hook 514 slides from the top portion 544 along the face portion 545 to the jaw portion 546, where the hook 514 is blocked from further upward movement, and the antenna 2 is locked in its retracted position. When an outside force pushes the antenna 2 down again, the hook 514 moves downwardly into the recess 560 of the island 56, the elastic element 3 is further compressed, and the antenna 2 moves downwardly. When the pushing force is removed, the elastic element 3 pushes outwardly, and the hook 514 moves upwardly along the abdomen portion 547 back to the tail portion 542 of the groove 54, to the antenna's fully extended position. The electrical connection between the antenna 2 and the transceiver (not shown) of the mobile phone is the same as for the lust embodiment.

The elastic element 3 is preferably a helical compression spring, one end of which is engaged with the upper part 20 of the antenna 2, and the other end of which is engaged with a surface of the support plate 18 of the housing 10.

In the present invention, the connecting means 50 and 51 are preferably connecting rods.

The antenna module 1, 1', of the present invention is for use with a mobile phone or other electronic device such as a radio, for receiving or transmitting wireless signals.

According to the above embodiments, the antenna 2 can be extended or retracted by a user using one hand to both hold the mobile phone and push down on the antenna 2. Using one hand, the user can move the antenna 2 between the extended position and the retracted position. This one-handed operation is possible because movement of the antenna 2 is regulated by the feed mechanism 5 or 5' and is aided by the elastic element 3. It is obvious that the antenna module 1 is easy-to-use. The design is simple and reliable.

It is understood that the invention may be embodied in other forms without departing from the spirit thereof. Thus, the present examples and embodiments are to be considered in all respects as illustrative and not restrictive, and the invention is not to be limited to the details given herein.

What is claimed is:

1. An antenna module comprising:

an antenna comprising an upper part and a lower part;

an elastic element surrounding the lower part of the antenna; and a feed mechanism comprising a connecting means and a groove, the connecting means movably engaging with and connecting between the antenna and the groove;

wherein the antenna is movable between an extended position and a retracted position, such movement being regulated by the feed mechanism and being aided by the elastic element; and the antenna module is for mounting in an electronic device, and movement of the antenna is activatable by one hand manipulation by a user, wherein the user presses inwardly on the antenna to retract the antenna, and once to extend the antenna.

2. The antenna module as claimed in claim 1, wherein a hole is defined through an end of the lower part of the antenna.

3. The antenna module as claimed in claim 2, wherein the connecting means has two hooks respectively at each end thereof, and one hook is rotatably engaged with said hole, and the other hook is slidably received in the groove.

4. The antenna module as claimed in claim 3, wherein the connecting means is a connecting rod.

5. The antenna module as claimed in claim 4, wherein the groove has a heart-like contour comprising two blocking portions and two lower portions, and wherein the first blocking portion arrests further upward movement of the antenna in the extended position, the second blocking portion arrests further upward movement of the antenna in the retracted position, the hook moves along the groove from the first blocking portion and passes through the first lower portion to the second blocking portion as the antenna is moved from the extended position to the retracted position, and the hook then moves along the groove from the second blocking portion and passes through the second lower portion to the first blocking portion as the antenna is moved from the retracted position to the extended position.

6. The antenna module as claimed in claim 1, wherein a pivot is perpendicularly formed on an end of the lower part of the antenna.

7. The antenna module as claimed in claim 6, wherein the connecting means defines a pivot opening at one end and comprises shook at the other end, said pivot rotatably engages with the pivot opening, and the hook is movably received in said groove.

8. The antenna module as claimed in claim 7, wherein the groove has a sea-horse shaped contour comprising a tail portion, a back portion, a top portion, a face portion, a jaw portion, and an abdomen portion, and wherein the top portion is disposed between and communicates with the back portion and the face portion.

9. The antenna module as claimed in claim 8, wherein an arcuate island is formed in the middle of said groove, and the arcuate island defines a recess.

10. An antenna module comprising:

an antenna comprising an upper part and a lower part;

an elastic element surrounding the lower part of said antenna; and a feed mechanism comprising a connecting rod and a groove, one end of the connecting rod comprising a first hook slidably received in said groove, and a second end of the connecting rod being rotatably engaged with said antenna;

wherein said antenna is movable between an extended position and a retracted position, such movement being regulated by the engagement of the first hook in said groove and being aided by the resilience of said elastic element.

11. The antenna module as claimed in claim 10, wherein a hole is defined through an end of the lower part of said antenna.

12. The antenna module as claimed in claim 11, wherein the second end of the connecting rod comprises a second hook rotatably engaged with said hole.

13. The antenna module as claimed in claim 12, wherein the groove has a heart-like contour comprising two blocking portions and two lower portion, and wherein the first blocking portion arrests further upward movement of said antenna in the extended position and the second blocking portion arrests further upward movement of said antenna in the retracted position.

14. The antenna module as claimed in claim 10, wherein a pivot is perpendicularly formed on one end of the lower part of said antenna.

15. The antenna module as claimed in claim 14, wherein the connecting rod defines a pivot opening through the second end, and wherein said pivot is rotatably engaged with the pivot opening.

16. The antenna module as claimed in claim 15, wherein the groove has a sea-horse shaped contour comprising a tail portion, a back portion, a top portion, a face portions a jaw portion, and an abdomen portion, and wherein the top portion is disposed between and communicates with the back portion and the face portion.

17. The antenna module as claimed in claim 16, wherein an arcuate island is formed in the middle of said groove, and the arcuate island defines a recess.

18. An electronic device with a retractable antenna, comprising:

a casing defining a periphery wall and a lengthwise direction;

a through opening formed in said periphery wall; and an antenna disposed in said casing, with an upper portion retractably extending through said through opening and out of the casing along an axial direction; wherein a lower portion of the antenna is equipped with a connecting device having means moving along a loop groove which defines two rest positions for determining the antenna to be in either an inner position or an outer position; wherein the connecting device is pivotally connected to the lower portion of the antenna.

19. The device as claimed in claim 18, wherein said axial direction is parallel to said lengthwise direction.

20. The device as claimed in claim 18, wherein said antenna is equipped with a spring to urge said upper portion outwardly.

* * * * *